United States Patent [19]

Yarwood et al.

[11] Patent Number: 4,516,625

[45] Date of Patent: May 14, 1985

[54] ELECTROMAGNETIC CONTROL SYSTEM FOR CASTING THIN STRIP

[75] Inventors: John C. Yarwood, Madison; Derek E. Tyler, Cheshire, both of Conn.

[73] Assignee: Olin Corporation, New Haven, Conn.

[21] Appl. No.: 456,687

[22] Filed: Jan. 10, 1983

[51] Int. Cl.[3] ..... B22D 11/16

[52] U.S. Cl. ..... 164/454; 164/455; 164/452; 164/467; 164/413; 164/414; 164/503

[58] Field of Search ..... 164/467, 492, 493, 503, 164/504, 413, 414, 454, 455

[56] References Cited

U.S. PATENT DOCUMENTS

| | | | |
|---|---|---|---|
| 2,686,864 | 8/1954 | Wroughton et al. | 164/498 |
| 3,467,166 | 9/1969 | Getselev et al. | 164/467 |
| 4,161,206 | 7/1979 | Yarwood et al. | 164/467 |
| 4,213,496 | 7/1980 | Yarwood et al. | 164/147 |
| 4,353,408 | 10/1982 | Pryor | 164/503 |
| 4,356,861 | 11/1982 | Winter | 164/462 |
| 4,388,962 | 6/1983 | Yarwood et al. | 164/503 |
| 4,415,017 | 11/1983 | Yarwood et al. | 164/503 |
| 4,419,177 | 12/1983 | Pryor et al. | 164/467 |
| 4,441,542 | 4/1984 | Pryor et al. | 164/467 |
| 4,446,908 | 5/1984 | Ungarean et al. | 164/452 |

FOREIGN PATENT DOCUMENTS

| | | | |
|---|---|---|---|
| 0037472 | 10/1981 | European Pat. Off. | 164/467 |

*Primary Examiner*—Nicholas P. Godici
*Assistant Examiner*—Maureen Weikert
*Attorney, Agent, or Firm*—Howard M. Cohn; Barry L. Kelmachter; Paul Weinstein

[57] ABSTRACT

An apparatus and process electromagnetically forms feed ribbon or rod material into a desired thin strip shape. Inductors contain and form the material in molten form into the desired shape. There are at least an upstream and downstream inductor for applying the magnetic field to the molten material. Both the upstream and downstream inductors may be jointly used to contain and form the molten material into the thin strip shape. An alternating current is applied to the inductors to generate the magnetic field. This magnetic field defines a containment zone for the molten material and a gap between the molten material and the inductors. The current is applied to the inductors so that the gap remains substantially constant. The feed material has an upstream and a downstream liquid-solid interface adjacent the upstream and downstream inductors, respectively, which define the molten material head and solid material portions of the material. The feed material is delivered to the containment zone at a desired delivery rate while the desired thin strip is withdrawn from the containment zone at a desired withdrawal rate. The location of each of the liquid-solid interfaces is monitored and their positions are controlled so that the desired thin strip shape is of uniform size and shape.

25 Claims, 2 Drawing Figures

ELECTROMAGNETIC CONTROL SYSTEM FOR CASTING THIN STRIP

This invention relates to an improved process and apparatus for producing thin strip from materials, particularly including semi-conductive materials such as silicon. The process and apparatus include a control system that provides improved cross-sectional uniformity and grain structure of the thin strip casting.

A considerable body of art has developed about the use of electromagnetic containment for casting metals. A typical electromagnetic casting apparatus comprises a three-part mold consisting of a water cooled inductor, a non-magnetic screen, and a manifold for applying cooling water to the resultant casting. An example of such an apparatus is disclosed in U.S. Pat. No. 3,467,166 to Getselev et al. The molten metal is contained without direct contact between the molten metal and any component of the mold. Then, the molten metal is solidified by the direct application of water from a cooling manifold to the solidifying shell of the casting.

The present invention is particularly related to the process and apparatus for controlling the electromagnetic casting system. Various approaches have been described in the prior art for controlling the excitation of the inductor in a manner so as to provide ingots of uniform cross section.

An elaborate discussion of the prior art relating to electromagnetic casting is found in U.S. Pat. Nos. 4,161,206 and 4,213,496 to Yarwood et al. Their prior art statements are intended to be incorporated by reference herein. The Yarwood et al. patents themselves deal with a control system for controlling the electromagnetic process.

An important function of electromagnetic casting control systems is to accommodate changes in the molten metal head due to fluctuations such as in the location of the solid-liquid interface with respect to the inductor. These changes in the interface position occur because of instabilities in casting apparatus such as the withdrawal mechanism, the coolant application system, etc. Variations in the height of the molten metal head caused by either movement of the solid-liquid interface, the upper surface of the molten metal or both causes an increase or decrease in the hydrostatic pressure exerted by the molten metal head. The result may be a unevenly formed casting with varying grain structure. The variations in hydrostatic pressure may be compensated for by controlling the excitation of the inductor. For example, U.S. Pat. No. 4,161,206 to Yarwood et al. utilizes an electromagnetic casting control system to minimize variations in the gap between the molten metal and the inductor. A reactive electrical parameter of the inductor which varies with the magnitude of the gap is compared to reference values and an error feedback signal is generated for adjusting the inductor excitation to minimize variations in the gap.

The gap stabilization system described above, in Yarwood et al., partially overcomes the instabilities associated with changes in hydrostatic pressure of the molten metal head to produce solidified castings of more uniform cross section. The inductor excitation control system operates most effectively when the hydrostatic pressure is kept within a preferred range. Therefore, long term changes in hydrostatic pressure due to height variations of the molten metal head are preferably minimized. Consequently, minimizing variations in molten metal head height and in the gap during a casting run are thought to be desirable.

In U.S. patent application Ser. No. 110,893, filed Jan. 10, 1980 by G. Ungarean et al. (now abandoned), an apparatus or process is provided for casting materials by forming molten material into a desired shape by applying a magnetic field to the molten material. The magnetic field defines a containment zone for the molten material. Variations in the hydrostatic pressure exerted by the molten material in the containment zone is sensed. In response thereto, the flow of molten material into the containment zone is controlled whereby the hydrostatic pressure remains substantially constant.

U.S. Pat. No. 4,353,408 to Pryor discloses an electromagnetic thin strip casting apparatus and process for forming thin strip castings of a variety of materials including semi-conductive materials such as silicon. An inductor generates an electromagnetic field for supporting a pool of molten material and for forming the material into the desired thin strip shape. The level of molten material in the pool is maintained substantially constant to reduce variations in the hydrostatic pressure exerted by the molten material in the containment zone. The reduction is accomplished by controlling the replenishment of the molten material pool in response to the sensed inductance of the inductor.

U.S. patent application Ser. No. 158,040, filed June 9, 1980 by J. Winter (now abondoned) describes an electromagnetic thin strip reforming apparatus and process for forming thin strip castings of a variety of materials including semi-conductive materials such as silicon. An input device conveys a starting strip of material to the electromagnetic apparatus, i.e. an inductor, to form a floating molten zone. An output device conveys the thin strip of material away from the electromagnetic device. The control of the relative speeds at which the strip is conveyed to and away from the electromagnetic apparatus alters the thickness of the final strip. The electromagnetic device is preferably controlled to maintain the air gap between the strip of material and a surrounding inductor constant. The present invention differs from Winter in that it provides a control system which maintains the liquid-solid interfaces substantially constant.

U.S. Pat. No. 4,356,861 to Winter discloses a process and apparatus for recrystallization of thin strip material. The process and apparatus are applied to existing strip material in order to provide single or preferred polycrystalline thin strip products. In addition, the process and apparatus provide reduced thickness of the original strip material and optionally provide improved thickness uniformity.

The present invention is particularly concerned with precise measurement of the two liquid-to-solid interface positions of the semi-metals being operated upon and controlling the process such that the liquid-to-solid interfaces do not substantially vary after they have been set in the desired positions. Accurate knowledge and control of the position of the liquid-to-solid interfaces can be a useful tool in improving overall performance of the apparatus. For example, it may be ideally desired to maintain the position of the lower liquid-to-solid interface at the longitudinal (magnetic) center of the lower inductor where the field is the greatest. This will counteract the maximum static force which is exhibited in the strip at the lower inductor. In addition, control of the two liquid-to-solid interface locations is essential in prevention of material spillout or cold folding. Also, additional control of the coolant impingement upon the solidifying strip may be provided at a more optimal location.

A desired way of determining the position of the liquid-to-solid interfaces is described in U.S. patent application Ser. No. 137,645 filed Apr. 7, 1980 (now abandoned), by P. J. Kindlmann et al. In that application, it is noted that the factors which tend to cause fluctations in the vertical positions of the solidification front include variations in casting speed, material superheat, coolant flow rate, coolant application position, coolant temperature and quality (impurity content) and inductor current amplitude and frequency. That patent application describes a number of techniques for measuring parameters of electromagnetic systems and the prior art statement is incorporated herein. More particularly, that application discloses a process and apparatus for determining and displaying molten metal head and liquid-solid interface position during an electromagnetic casting run. The in-phase component of the voltage across the inductor is preferably utilized as an indicator of head and interface position. The equivalent series resistance (ESR) of the casting system, including the load, is measured and monitored during the casting run. The value of this parameter is then compared with a table or chart relating the ESR, the system and the values of or changes in the values of head and liquid-solid interface position for a given metal or alloy being cast. In this way, the location or changes in location of the liquid-solid interface of an electromagnetically cast ingot during an electromagnetic casting run may be determined without inserting or placing probes or other devices into the primary casting zone and without alteration of the inductor construction, or other primary elements of the electromagnetic casting apparatus. That application differs from the present invention in that it is not concerned with the control of the entire system whereby the shape of the outcoming strip and its grain structure may be accurately controlled as desired.

Another technique for measuring liquid-solid interface utilizes a plurality of fiber optic filaments secured within elements of an electromagnetic casting system, e.g. within the shield and/or manifold and/or inductor, to measure and determine the load surface height and location of the liquid-solid interface. This system is disclosed in co-pending U.S. patent application Ser. No. 111,244 filed Jan. 11, 1980 by Ungarean et al. for "Infrared Imaging for Electromagnetic Casting". The system uses infrared radiation emitted from the surface of the forming ingot as a measure of the desired parameters. This systm has the benefits of not requiring the insertion of probes into the primary casting zone and provides other information, such as liquidus temperature and maximum temperature. One problem with this approach, however, is that the system of filaments is inserted within elements of the casting system, requiring modification of the effective elements.

It is a problem underlying the present invention to form a strip of uniform size and shape by liquid-solid interface control of the molten material in the strip as it passes through an electromagnetic casting system.

It is an advantage of the present invention to provide an apparatus for casting a material into a desired shape which obviates one or more of the limitations and disadvantages of the described prior arrangements.

It is a further advantage of the present invention to provide an apparatus for casting a material into a desired shape wherein the control system responds to variations in the equivalent series resistance of the electromagnetic system.

It is a still further advantage of the present invention to provide an apparatus for casting a material into a desired shape wherein a control apparatus adjusts the variations in the liquid-to-solid interfaces by changing the delivery and withdrawal rate of the strip material into the electromagnetic system.

It is a yet further advantage of the present invention to provide an apparatus for casting a material into a desired shape wherein a controlled apparatus adjusts the variations in the liquid-to-solid interfaces by changing the rate, temperature or contact location of the coolant against the solidifying strip.

It is a still further advantage of the present invention to form feed ribbon or rod material into a desired thin strip shape including preheaters and postheaters located upstream and downstream from the electromagnetic casting apparatus, which are adjusted to reduce variations in the liquid-to-solid interfaces.

Accordingly, there has been provided an apparatus and process for electromagnetically forming feed ribbon or rod material into a desired thin strip shape. Inductors contain and form the material in molten form into the desired shape. There are at least upstream and downstream inductors for applying the magnetic field to the molten material. Both the upstream and downstream inductor may be jointly used to contain and form the molten material into the thin strip shape. An alternating current is applied to the inductors to generate the magnetic field. This magnetic field defines a containment zone for the molten material and a gap between the molten material and the inductors. The current is applied to the inductors so that the gap remains substantially constant. The feed material has an upstream and a downstream liquid-solid interface adjacent the upstream and downstream inductors, respectively, which define the molten material head and solid material portions of the material. The feed material is delivered to the containment zone at a desired delivery rate while the desired thin strip is withdrawn from the containment zone at a desired withdrawal rate. The location of each of the liquid-solid interfaces is monitored and their positions are controlled so that the desired thin strip shape is of uniform size and shape.

The invention and further developments of the invention are now elucidated by means of preferred embodiments shown in the drawings.

Figure 1:
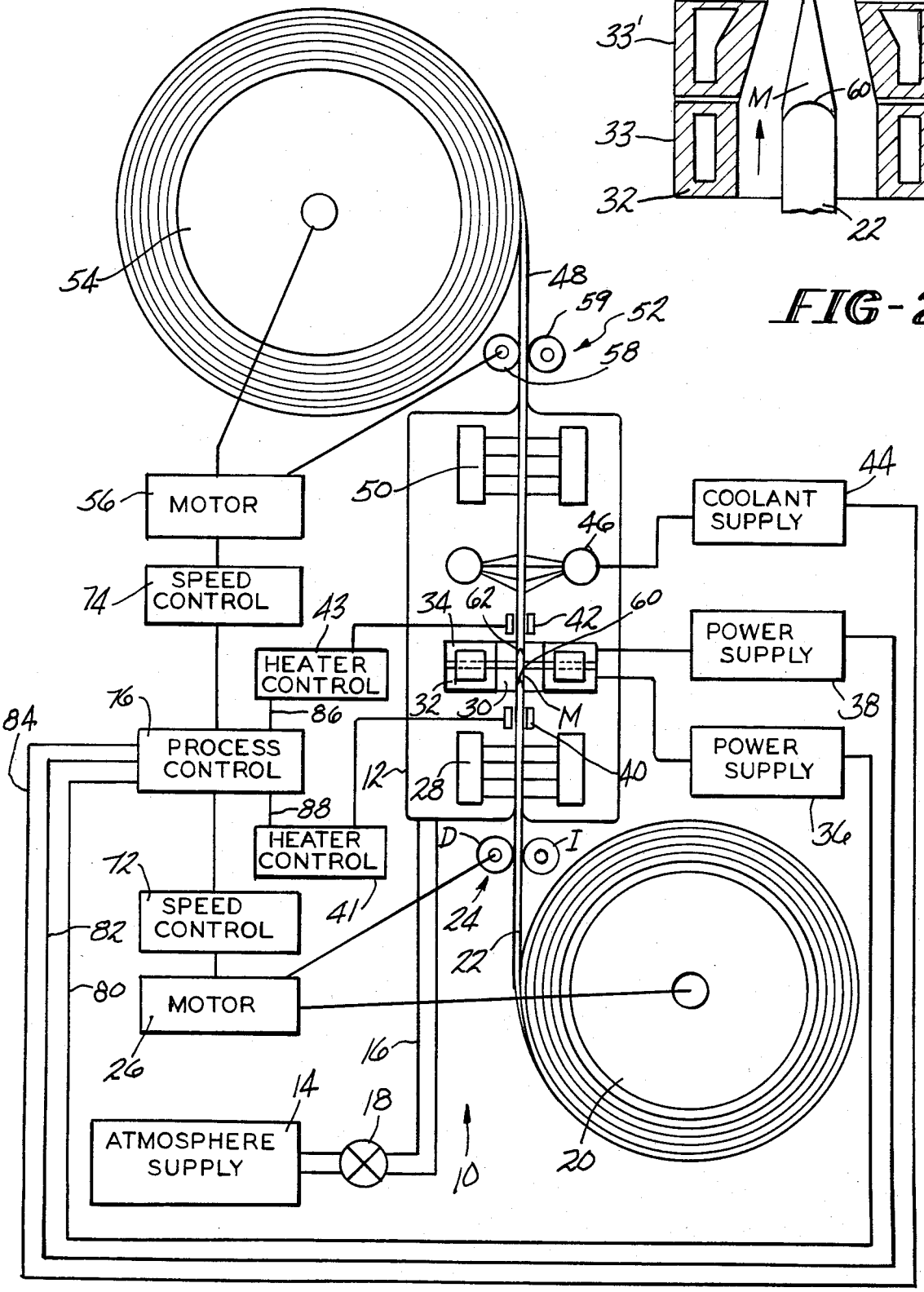
FIG. 1 is a schematic representation of an apparatus for forming feed ribbon or rod material into a desired thin strip shape in accordance with the present invention.

Referring now to FIG. 1, an apparatus 10 is adapted for carrying out a strip forming process. The apparatus 10, as shown, includes an atmosphere controlled chamber 12 for performing the process in a desired atmosphere to reduce the possibility of contamination. Although a suitable atmosphere may comprise argon gas, any desired atmosphere may be utilized. The atmosphere is provided from a suitable atmosphere supply 14 which is connected to the processing chamber 12 by conduit 16 and valve 18. The atmosphere supply 14 may be of conventional design and does not form a part of the present invention.

The apparatus 10 includes a first payoff reel 20 of the starting strip material 22. A first capstan drive 24 is arranged adjacent the payoff reel 20 for controlling the delivery rate of speed at which the starting strip material 22 is paid off the payoff reel 20. The capstan drive 24 may be gear driven by motor 26 whose speed may be controlled as described hereinbelow. The capstan drive 24 comprises opposed driven D and idling I pinch rolls. The payoff reel 20 may also be gear driven by motor 26 through a slip clutch (not shown) at a relatively slower speed than the capstan drive 24. The strip 22 advances slightly more quickly through capstan 24 to create a slight tension on strip 22 between payoff reel 20 and capstan drive 24. The strip 22 passes through the nip of the capstan drive rolls 24 and into a first guide device 28 which properly aligns the strip 22 for passage into processing station 30. The guide device 28 may be of any conventional design such as rollers, slides, or brushes as shown. The brushes are preferably formed of an inert material which will not contaminate the strip 22 and which are heat resistant. A suitable material would comprise fibers of polytetrafluro-ethylene.

The strip 22 is then forwarded through the electromagnetic containment and melting station 30 in accordance with the present invention. It is preferred in accordance with this invention that the electromagnetic containment and melting station comprise at least two inductors 32 and 34. The latter are powered by supplies 36 and 38 in a manner so as to both melt the incoming strip 22 to form the floating molten zone and also to contain and form the molten material into the desired strip cross section.

While it is preferred to use inductors 32 and 34 for simultaneously forming and containing the molten material and for providing the necesssary heat input to melt the incoming strip if desired, the melting operation could be provided by a separate heating source 40 located upstream and adjacent to inductor 32. The heating source could be another inductor or a laser or any other desired heat input system. Also, a second separate heating source 42 downstream and adjacent to inductor 34, which may be similar to heater 40, is provided. Heaters 40 and 42 are operated by heater controls 41 and 43, respectively. Heater 42 may be used to more precisely control the heat removal from strip 22 so that desired grain structure and shape of the strip is achieved.

A suitable coolant from supply 44 is applied by spray manifold 46 to the resulting thin strip shape 48 after passing through the containment inductors 32 and 34. The coolant may comprise any desired coolant material such as argon gas or water and it can be gaseous or liquid as desired. Inert gas is suitable when strip 48 is advanced at a relatively slow rate as might be the case for single crystal growth. The use of water is more suited to high speed travel of the strip.

The solidified strip is then passed through a second guide device 50 constructed of brushes in a manner similar to that of the first guide device 28.

A second capstan drive 52 is arranged adjacent the takeup reel 54 for controlling the rate of speed at which the resulting strip material is withdrawn from the containment zone 30. The capstan drive 52 following the containment station 30 is gear driven by motor 56 whose speed may be controlled as described below. The capstan drive 52 also comprises opposed driven 58 and idling 59 pinch rolls. The strip 48 is threaded through the nip of the capstan drive rolls 52 and onto the takeup reel 54. The takeup reel 54 is also gear driven by motor 56 through a slip clutch (not shown). Reel 54 is operated at a relatively higher speed than capstan drive 52. The strip 48 advances slightly more slowly through capstan 52 to create a slight tension on the strip 48 between the takeup reel 54 and capstan drive 52.

For brittle materials, such as silicon, the reels 20 and 54 are relatively large in diameter so as not to exceed the flexibility of material.

The incoming strip 22 is fed to the melting and containment station 30 and the exiting solidified strip 48 is withdrawn from that station 30 by the aforenoted motors 26 and 56 and capstan drives 24 and 52. The speed of each capstan drive is regulated by conventional speed controls 72 or 74, respectively. The latter speed controls are actuated by a process control system 76. The process control system 76 may include a conventional switch bank arrangement wherein a plurality of selectable speed levels can be selected for each motor 26 or 56 through speed controls 72 or 74. The control system 76 may comprise any desired arrangement for selectively controlling the speeds of the motors 26 and 56. Further, in accordance with this invention, control system 76 may utilize a computer to automatically regulate the speed controls 72 and 74 for driving motors 26 and 56 at their desired speeds.

The inductors 32 and 34 are independently excited by an alternating current from power supplies and control systems 36 and 38 which may be of any desired design. However, preferably it is in accordance with the teachings of U.S. Pat. No. 4,161,206 to Yarwood et al. In that approach, current in the inductors 32 and 34 is controlled to maintain the inductance of the inductors 32 and 34 substantially constant. This insures a uniform air gap between the molten material M and the surrounding inductors 32 or 34 during a casting run.

Figure 2:
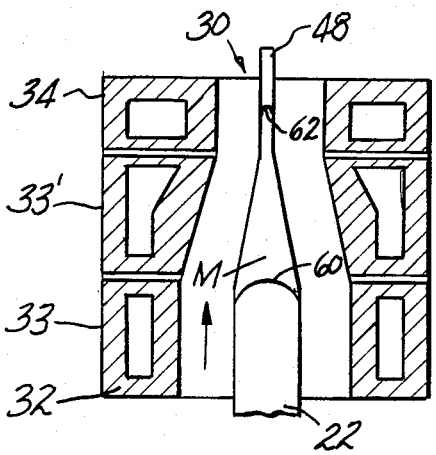
FIG. 2 is a schematic representation of a specific inductor configuration in accordance with the present invention.

The process may employ a pair of inductors (single and multi-turn as shown in FIG. 2), a single inductor a multiple inductors. Major section changes may require multiple inductors whereas smoothing of an irregular ribbon may only require a single inductor.

The inductors are powered to preferably contain and support the molten material in the floating molten zone M as well as heat the material in the zone M to a temperature where the incoming strip melts as it advances into the melting and containment zone. This is accomplished by balancing the pressure and heat input provided by the inductors.

The floating molten zone M, contained and shaped by the electromagnetic forces, is capable of overcoming surface tension and gravity effects. The molten zone M moves progressively along the strip 22 in a given direction and should increase the purity of the resultant strip 48 in accordance with conventional zone refining principles.

For a thinning mode of operation of the apparatus 10, the frequency of the current applied to the upstream inductor 32 is substantially lower than the frequency applied to the downstream inductor 34. The downstream inductor 34 preferably has an applied current whose frequency is in the range of at least one to five megahertz and preferably at least three megahertz. The upstream inductor 34 may be powered at a substantially lower frequency of from about 100 kilohertz to about 800 kilohertz and preferably from about 300 kilohertz to about 600 kilohertz.

Referring to FIG. 2, there is illustrated an embodiment of the invention where the upstream inductor 32 may be comprised of at least two loops 33 and 33' for heating, containment and rough shaping of strip 22 and molten zone M. A substantial thinning in cross section of the strip 22 is achieved by loop 33' in this arrangement. The molten zone M has a funnel shape to account for the thinning action. The downstream inductor 34 provides the shaping and containment to form the final strip 48 and preferably has the smallest cross section transverse to the casting direction of molten zone M. The upstream inductor 32 opposes the largest transverse thickness of molten material M and, therefore, may be powered at a markedly lower frequency than downstream inductor 34. The middle coil 33' opposes the major transition zone between the thicker strip 22 and the thinner strip 48 and is provided with a constantly reducing cross section transverse to the molten zone M to decrease the cross section of the molten zone to roughly the desired size of finished strip 48.

Although the casting system as illustrated provides for material flow in an upward direction, it is also within the terms of the present invention for the material flow to be substantially downward or in any other desired direction.

The present invention is particularly directed to the elimination of the fluctuations in the location of the liquid-solid interfaces 60 and 62 with respect to the inductors 32 and 34, respectively. The changes in the interface position occur due to instabilities in the casting apparatus such as in the delivery or withdrawal mechanisms, the coolant application system, the associated heating systems, and the power supplies and their inductors. Variations in either of the liquid-solid interfaces change the height of the molten metal head M and a resultant change in the hydrostatic pressure exerted by the molten metal head. The result of this change may be an unevenly-formed casting with varying grain structure. The variations in the hydrostatic pressure may be somewhat compensated for by controlling the excitation of the inductors 32 and 34 as described above with reference to the teachings of U.S. Pat. No. 4,161,206 to an electromagnetic casting control system for minimizing variations in the gap. Although this gap stabilization system partially overcomes the instabilities associated with changes in hydrostatic pressure, there is a limitation that the control system operates most effectively when the hydrostatic pressure is kept within a preferred range. Therefore, any long term changes in hydrostatic pressure due to height variations of the molten metal head are preferably minimized. This is accomplished by controlling the liquid-to-solid interface positions.

Accordingly, the present invention is particularly concerned with precise measurement of the two liquid to solid interface positions 60 and 62 of the semi-metals being operated upon and controlling the process such that the liquid-to-solid interfaces do not substantially vary from their desired preset positions. Also, the invention may be useful to ideally maintain the position of the liquid-to-solid interfaces at the longitudinal center of the two inductors where the fields are the greatest. This location will most efficiently counteract the maximum static force which is exhibited in the strip at this point. In addition, it is essential to control the liquid-to-solid interface location in order to prevent material spillout, i.e. the interface 60 moves too low or the interface 62 moves too high for adequate containment of the molten head M. Also, if the liquid-to-solid interfaces were to move too close to one another, the molten material may solidify prematurely resulting in the molten material being formed into an undesirable irregular shape. There are a number of ways to control the position of the two liquid-to-solid interfaces once their locations have been precisely measured.

The variations in the liquid-to-solid interface positions may be determined by measuring the equivalent series resistance of each of the inductors in accordance with the teachings of U.S. patent application Ser. No. 137,645, (now abandoned), by Kindlmann et al. entitled "Determination of Liquid-Solid Interface and Head in Electromagnetic Casting". A resistive electrical parameter of each inductor which varies with the position of the liquid-to-solid interface is compared to reference values and a error signal is generated representing the variation of the liquid-solid interfaces from their preset positions. An elaborate discussion of the prior art relating to control systems for electromagnetic casting is found in this patent application and its prior art statement is intended to be incorporated by reference herein.

By monitoring the ESR of each of the inductor systems through monitoring the in-phase component of the current in each inductor and the in-phase voltage component across each inductor, it is possible to utilize these measurements of resistive voltage drops as indicators of both the liquid-solid interface positions and the height of molten head M.

As briefly explained above, determination of liquid head M and liquid-solid interface positions 60 and 62 are carried out by interpolation. Values of the ESR for different geometric arrangements, values of M and liquid-solid load resistivity can be determined by suitable modeling and empirical measurement procedures and thereafter confirmed by careful measurement during actual electromagnetic casting experiments. Thus, scaling is preferably performed by empirical measurement based solely on experiment utilizing a model system and observation of a particular geometric and material electromagnetic casting system.

In stabilizing and controlling the position of the liquid-solid interfaces and the temperature gradients through the floating zone to those values required for single crystal or controlled grain growth, sensing the ESR of the inductors is particularly advantageous in systems using semi-metals as compared to other metals or alloys. There is an approximately 20 to 1 change in resistivity in melting shown by semi-metals as compared to an approximate 2 to 1 change for typical metals or alloys. A large change in resistivity is much easier to measure since the measurement of the reactance of the circuit can mask over the resistivity measurement. Further details about the operation and specific circuitry needed to measure the position of the liquid-solid interfaces is disclosed in the Kindlmann et al. application. Although it is preferred to sense the liquid-solid interfaces using the method just described, it is also within the terms of the present invention to use any other desired technique such as infrared imaging as disclosed in U.S. patent application Ser. No. 111,244 to Ungarean et al. That application discloses an infrared detector for sensing and collecting infrared radiation emanating from the surface at the solidification zone (which includes the liquid-to-solid interface) of the load, and for providing a signal representative of the position of the liquid to solid interface. The invention preferably includes sensing the infrared emanation being emitted from the surface of the load by fiber optic filaments secured within elements of the electromagnetic casting system. The apparatus of this invention allows for the determination of the liquid-solid interface as well as other parameters such as load height, maximum temperature of the load and liquidus temperature by measuring the infrared radiation being emitted from the surface of the load. An apparatus is also provided for transmitting radiation signals by the filaments to a signal processor to enable display of the information for operator use or possible automatic control.

The sensed positions of the two liquid-to-solid interfaces 60 and 62 may be determined by circuitry associated with the power supplies 36 and 38 and relayed to the process control box via lines 80 and 82. The process control 76 can regulate the speed controls 72 and/or 74 to govern the speeds of the material feed or the material withdrawal so as to offset any movement in the liquid-to-solid interface. For example, if the downstream freezing liquid-to-solid interface 62 is sensed to be advancing in an upwards direction, the speed of withdrawal can be decreased in order to offset this effect. Likewise, if the melting upstream liquid-to-solid interface 60 is advancing in an upwards direction, the rate of material feed can be decreased to thereby readjust the position of the liquid-to-solid interface 60. Furthermore, it may be necessary to operate auxiliary heaters 40 and 42 for initial melting of the strip 22 or delaying the cooling of the formed strip 48. These heaters can also be operated in response to positions of the liquid-to-solid interfaces and controlled by the heater control boxes 41 and 43 which are connected to the process control by lines 88 and 86, respectively. Another control of the downstream liquid-to-solid interface 62 may be provided by the coolant application through manifold 46. Here again, the downstream liquid-to-solid interface can indicate to the process control to signal the coolant supplied through 84 to change the quantity or temperature of coolant supply.

The patents and patent applications set forth in the specification are intended to be incorporated by reference herein.

While the invention has been described generally by reference to semi-conductor materials such as silicon, it is adapted for use with a wide range of such semi-metals, metalloids, semi-conductive, or compound semi-conductive materials including germanium, sapphire, galliumarsenide or the like. These materials are mentioned by way of example, and it is not intended to exclude other metalloids or semi-metal type materials. In addition, the present invention may be adapted for use with various metals including copper and copper alloys, steel and steel alloys, aluminum and aluminum alloys, nickel and nickel alloys, titanium, zirconium, vanadium, tantalum, molybdenum, although other metals and alloys are not intended to be excluded.

It is apparent that there has been provided in accordance with this invention an electromagnetic control system for casting thin strip which fully satisfy the objects, means, and advantages set forth hereinabove. While the invention has been described in combination with the specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. In an apparatus for forming material such as feed ribbon or rod material into a desired thin strip shape, said material including during said forming an upstream and a downstream liquid-solid interface, defining molten material head and solid material portions of said material;

means for electromagnetically containing and forming said material in molten form into said desired thin strip shape, said electromagnetic containing and forming means comprising: inductor means having at least upstream and downstream sections respectively arranged to be adjacent said upstream and downstream liquid-solid interfaces for applying a magnetic field to said molten material;

means for applying an alternating current to said inductor means to generate said magnetic field, said magnetic field defining a containment zone for said molten material and a gap between said molten material and said inductor means;

means for delivering said feed material to said containment zone at a delivery rate;

means for withdrawing said desired thin strip from said containment zone at a withdrawal rate;

means for monitoring the location of said upstream and downstream liquid-solid interfaces; and control means responsive to the monitoring means for controlling the location of said upstream and downstream liquid-solid interfaces so as to reduce variations in the grain structure of the desired thin strip.

2. The apparatus of claim 1 wherein said control means includes means for varying the delivery rate of said feed material to control the location of said upstream liquid-solid interface.

3. The apparatus of claim 2 wherein said control means further includes means for varying the withdrawal rate of said desired thin strip to control the location of said downstream liquid-solid interface.

4. The apparatus of claim 3 wherein said control means further includes cooling means downstream from said inductor means for applying a coolant at a desired rate to control the location of said downstream liquid-solid interface.

5. The apparatus of claim 4 wherein said control means further includes upstream heating means located upstream and adjacent to said inductor means and downstream heating means located adjacent to and downstream from said inductor means for applying heat to said feed material and said desired thin strip, respectively, in response to the respective locations of said upstream and downstream liquid-solid interfaces.

6. The apparatus of claim 5 wherein said control means further includes:

means for varying the amount of heat applied by said upstream heating means to control the location of said upstream liquid-solid interface; and means for varying the amount of heat applied by said downstream heating means to control the location of said downstream liquid-solid interface.

7. The apparatus of claim 6 wherein said means for delivering and withdrawing include first and second capstan drive means, respectively, independently operated to provide desired delivery and withdrawal rates.

8. The apparatus of claim 7 further including first and second speed control means for controlling the speed of said first and second capstan drive means, respectively, to independently control the delivery and withdrawal rates.

9. The apparatus of claim 1 wherein said upstream section comprises an upstream inductor and said downstream section comprises a downstream inductor.

10. The apparatus of claim 9 wherein said upstream inductor includes at least two coils; a first of said coils disposed on the upstream side defining a first portion of said containment zone having a first cross-sectional area for primarily heating and containing the material, the second of said coils defining a second portion of the containment zone having a second cross-sectional area smaller than said first cross-sectional area for forming and containing the molten material.

11. The apparatus of claim 10 wherein said downstream inductor defines a third portion of the containment zone having a third cross-sectional area smaller than said second cross-sectional area for containing and forming the molten material into said desired shape.

12. The apparatus of claim 11 wherein said means for applying an alternating current applies a current having a first frequency to said upstream inductor, and a current having a second frequency substantially higher than said first frequency to said downstream inductor.

13. The apparatus of claim 9 wherein the monitoring means includes means for determining the equivalent series resistance of each of said inductors which varies with variations in the location of the liquid-solid interface associated with each inductor.

14. The apparatus of claim 9 wherein the monitoring means includes means for measuring the infrared radiation emanating from the material surface at the liquid-solid interfaces which varies with variations in the locations of the two liquid-solid interfaces.

15. The apparatus of claim 1 further including means for controlling the current applied to said inductor means whereby said gap remains substantially constant.

16. A process for forming material such as feed ribbon or rod material into a desired thin strip shape, said material including during said forming an upstream and a downstream liquid-solid interface defining molten material head and solid material portions of said material, said process comprising the steps of:

electromagnetically containing and forming said material in molten form into said desired thin strip shape;

providing at least one inductor having upstream and downstream sections respectively arranged to be adjacent said upstream and downstream liquid-solid interfaces for applying a magnetic field to said molten material head;

applying an alternating current to said upstream and said downstream sections of said at least one inductor to generate said magnetic field, wherein said magnetic field defines a containment zone for said molten material and a gap between said molten material and said inductor;

delivering said feed material to said containment zone at a delivery rate;

withdrawing said desired thin strip from said containment zone at a withdrawal rate;

monitoring the location of said upstream and downstream liquid-solid interfaces; and controlling the location of said upstream and downstream liquid-solid interfaces so as to reduce variations in the grain structure of the desired thin strip.

17. The process of claim 16 wherein the step of controlling includes the step of varying the delivery rate of said feed material to control the location of said upstream liquid-solid interface.

18. The process of claim 17 wherein the step of controlling further includes the step of varying the withdrawal rate of said desired thin strip to control the location of said downstream liquid-solid interface.

19. The process of claim 18 wherein the step of controlling further includes the step of applying a coolant downstream of said inductor at a desired rate to control the location of said downstream liquid-solid interface.

20. The proces of claim 19 wherein the step of controlling further includes the steps of:

providing an upstream heating device disposed upstream and adjacent to the upstream section of said at least one inductor for applying heat to said feed material, and providing a downstream heating device located adjacent to and downstream from the downstream section of said at least one inductor for applying heat to said desired thin strip.

21. The process of claim 20 wherein the step of controlling further includes the steps of:

varying the amount of heat applied by said upstream heating device to control the location of said upstream liquid-solid interface; and varying the amount of heat applied by said downstream heating device to control the location of said downstream liquid-solid interface.

22. The process of claim 16 wherein said step of providing at least one inductor comprises providing an upstream inductor comprising said upstream section and a downstream inductor comprising said downstream section.

23. The process of claim 22 wherein the step of monitoring includes the step of determining the equivalent series resistance of each of said upstream and downstream inductors which varies with variations in the location of the liquid-solid interface associated with each of said inductors.

24. The process of claim 22 wherein the step of monitoring includes the step of measuring the infrared radiation emanating from the material surface at the liquid-solid interfaces which varies with variations in the locations of the two liquid-solid interfaces.

25. The process of claim 16 wherein the step of controlling includes controlling the current applied to said at least one inductor whereby said gap remains substantially constant.

* * * * *